United States Patent [19]

Takizawa et al.

[11] Patent Number: 4,648,247

[45] Date of Patent: Mar. 10, 1987

[54] LOW-TEMPERATURE SHOWCASE

[75] Inventors: Takashi Takizawa; Tsutomu Tanaka, both of Gunma, Japan

[73] Assignees: Sanyo Electric Co, Japan; Tokyo Sanyo Electric, both of Japan

[21] Appl. No.: 790,268

[22] Filed: Oct. 22, 1985

[30] Foreign Application Priority Data

| | | | |
|---|---|---|---|
| Oct. 24, 1984 | [JP] | Japan | 59-223737 |
| May 9, 1985 | [JP] | Japan | 60-98242 |
| May 21, 1985 | [JP] | Japan | 60-75407 |

[51] Int. Cl.[4] ..... A47F 3/04

[52] U.S. Cl. ..... 62/256; 74/96; 251/77; 251/129.11; 251/279

[58] Field of Search ..... 62/255, 256; 251/77, 251/129.11, 279; 74/96

[56] References Cited

U.S. PATENT DOCUMENTS

| | | | |
|---|---|---|---|
| 2,960,844 | 11/1960 | Quick | 62/256 X |
| 3,082,612 | 3/1963 | Beckwith | 62/256 |
| 3,094,851 | 6/1963 | Beckwith | 62/256 |
| 3,122,892 | 3/1964 | Beckwith | 62/256 X |

*Primary Examiner*—William E. Tapolcai

*Attorney, Agent, or Firm*—Darby & Darby

[57] ABSTRACT

A low-temperature showcase in which a double air curtain can be formed for commodity inlet-outlet opening provided in one side of its main body comprising: a heat exchanger in an inner passage being positioned upstream of and at a predetermined distance from another heat exchanger in an outer passage with respect to the same direction of air flows, a partition wall defining the inner and outer passages and having a first window at a portion thereof between the two heat exchangers, a closure plate for opening or closing the first window to close or open the inner passage downstream of the first window, and first control unit for giving instructions to the closure plate for its operation, the first control unit being operative to instruct the closure plate to open the first window and close the inner passage downstream of the first window when the heat exchanger in the inner passage is operated for defrosting with the heat exchanger in the outer passage operated for refrigeration, whereby the air flow through the heat exchanger in the inner passage is guided into the outer passage through the opened first window and cooled by being passed through the heat exchanger in the outer passage.

22 Claims, 17 Drawing Figures

LOW-TEMPERATURE SHOWCASE

FIELD OF THE INVENTION

The present invention relates to low-temperature showcases, and more particularly to a low-temperature showcase in which a double air curtain can be formed for a commodity inlet-outlet opening provided in one side of its main body.

RELATED ART STATEMENT

Conventional low-temperature showcases of this type include an open showcase which comprises a case main body having in one side thereof an inlet-outlet opening for commodities and including an inner wall, an outer wall and a partition wall defining between the inner and outer walls an inner passage and an outer passage for passing air therethrough, two heat exchangers disposed in the inner and outer passages respectively for providing refrigeration cycles along with a compressor, condenser and reducing valves, and two blowers disposed in the inner and outer passages respectively for passing air through the two passages in the same direction, so that at least a double air curtain can be formed for the opening with the air circulated through the inner and outer passages (see Examined Japanese Pat. Publication No. SHO 4224797 and corresponding U.S. Pat. No. 3,147,602).

During refrigeration, a liquid refrigerant is passed through the two heat exchangers for evaporation to cool the air circulated through the inner and outer passages, while during defrosting operation a hot gas (hot high-pressure gaseous refrigerant supplied directly from the compressor) is passed through the heat exchanger in the inner passage (inner heat exchanger) for condensation to defrost the inner heat exchanger by heat exchange. The known open showcase therefore has the following problems.

(1) While the hot gas is passed through the inner heat exchanger for condensation during defrosting operation, no cold source is available for cooling the air in circulation through the passage, consequently raising the temperature of the air in circulation and of the air within the storage chamber to produce an undesirable influence on the commodities in the showcase.

(2) To prevent the refrigerant liquefied by the inner heat exchanger from returning to the compressor during defrosting operation, there is a need to provide some heating means which operates during defrosting to evaporate the liquid refrigerant. This prevents effective use of the liquid refrigerant, increases the number of components of the refrigerator and renders the device expensive.

SUMMARY OF THE INVENTION

The present invention provides a low-temperature showcase which comprises a case main body having in one side thereof an inlet-outlet opening for commodities and including an inner wall, an outer wall and a partition wall defining between the inner and outer walls an inner passage and an outer passage for passing air therethrough, two heat exchangers disposed in the inner and outer passages respectively for providing refrigeration cycles along with a compressor, a condenser and reducing valves, and blowers disposed in the inner and outer passages respectively for passing air through the two passages in the same direction, whereby at least a double air curtain can be formed at the inlet-outlet opening with the air circulated through the inner and outer passages.

According to the present invention, the heat exchanger in the inner passage is positioned upstream of, and at a predetermined distance from, the other heat exchanger with respect to the direction of air flows. The partition wall has a first window at a portion thereof between the two heat exchangers. The showcase further comprises first passage change-over means for opening or closing the first window to close or open the inner passage downstream of the first window, and first control means for giving instructions to the first passage changeover means for its operation. When the heat exchanger in the inner passage is operated for defrosting with the heat exchanger in the outer passage operated for refrigeration, the first control means instructs the first passage changeover means to open the first window and close the inner passage downstream of the window, whereby the air through the exchanger in the inner passage is guided into the outer passage through the opened first window and cooled by being passed through the heat exchanger in the outer passage. Consequently, the air circulated through the inlet-outlet opening can be prevented from rise of temperature, enabling the showcase to store the commodities therein at a low temperature.

Further according to the present invention, the partition wall has a second window at a portion thereof downstream of the heat exchanger in the outer passage. The showcase further comprises second passage change-over means for opening or closing the second window to close or open the outer passage downstream of the second window, and second control means for giving instructions to the second passage change-over means for its operation. When the heat exchanger in the inner passage is operated for defrosting with the heat exchanger in the outer passage operated for refrigeration, the second control means instructs the second passage change-over means to open the second window so that the cold air flowing through the heat exchanger in the outer passage can be partly or wholly guided into the inner passage through the second window.

Further according to the present invention, for the refrigeration cycle, the reducing valves are respectively connected in series to the two heat exchangers in the inner and outer passages, and these series circuits are connected in parallel with each other. The showcase further includes a bypass circuit connected between the heat exchanger in the inner passage and the compressor or the condenser for guiding a hot high-pressure gas refrigerant, or a hot liquid refrigerant from the condenser directly to the heat exchanger in the inner passage, and electromagnetic valves included in the bypass circuit for guiding the hot high-pressure gas refrigerant or hot liquid refrigerant from the heat exchanger in the inner passage to the other heat exchanger in the outer passage when the former heat exchanger is operated for defrosting.

DESCRIPTION OF THE PREFERRED EMBODIMENTS

Figure 1:
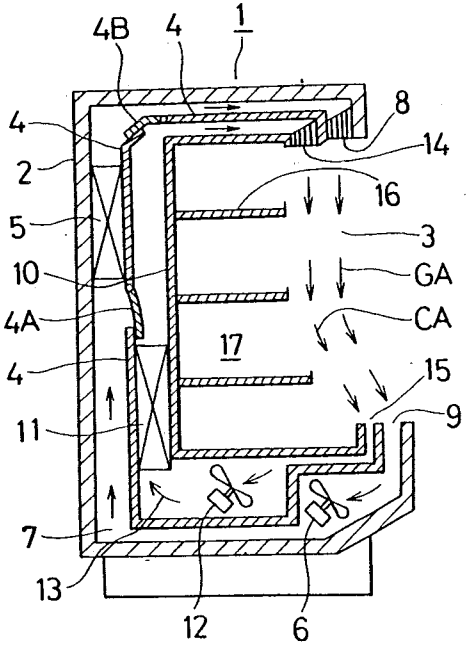
FIG. 1 is a view in vertical section showing a low-temperature showcase embodying the present invention.

FIG. 1 shows a low-temperature open showcase 1, the main body of which has an inlet-outlet opening 3 for commodities at its front side and is made of a heat insulating wall 2. The main body has in its interior a first partition plate 4 of heat insulating properties at a suitable distance from the inner surface of the heat insulating wall 2. The first partition plate 4 has a first damper 4A openable toward the inner passage to be described below and a second damper 4B openable toward an outer passage 7 defined by the partition plate 4 and the insulating wall 2. The partition plate 4 is formed with first and second windows 4C and 4D closable by the dampers 4A and 4B, respectively. An outer heat exchanger 5 of the plate fin type and an outer blower 6 of the axial flow type are disposed in the outer passage 7. The outer passage 7 has an air outlet 8 along the upper edge of the opening 3 and an air inlet 9 provided along the lower edge of the opening 3 and opposed to the outlet 8. A second partition plate 10 of metal as an inner wall is disposed inwardly of the first partition plate 4 at a suitable distance therefrom to define an inner passage 13 by the plates 10 and 4. An inner heat exchanger of the plate fin type, 11, and an inner blower 12 of the axial flow type are arranged in the inner passage 13. The inner passage 13 has an air outlet 14 along the upper edge of the opening 3 inwardly of the air outlet 8 and an air inlet 15 provided alongside the outer air inlet 9 inside thereof and opposed to the outlet 14. The interior space of the main body serves as a storage chamber 17 having a plurality of shelves 16. The first and second dampers are each in the form of a plate made of a heat insulating material, such as resin. The first damper 4A is disposed upstream from the second damper 4B with respect to the direction of flow of the air to be circulated. Preferably, the free end of the first damper 4A comes into contact with the outer surface of the second partition plate 10 when the damper is opened. It is also desired that when the second damper 4B is in its open position, the free end thereof bear on, or be positioned close to, the inner surface of the heat insulating wall 2. The outer heat exchanger 5 in the outer passage 7 is positioned between the first and second dampers 4A, 4B, while the inner heat exchanger 11 is positioned upstream of the first damper 4A with respect to the direction of air circulation. The first and second dampers are opened or closed by suitable drive means comprising a gear motor, hydraulic cylinder or the like.

Figure 2:
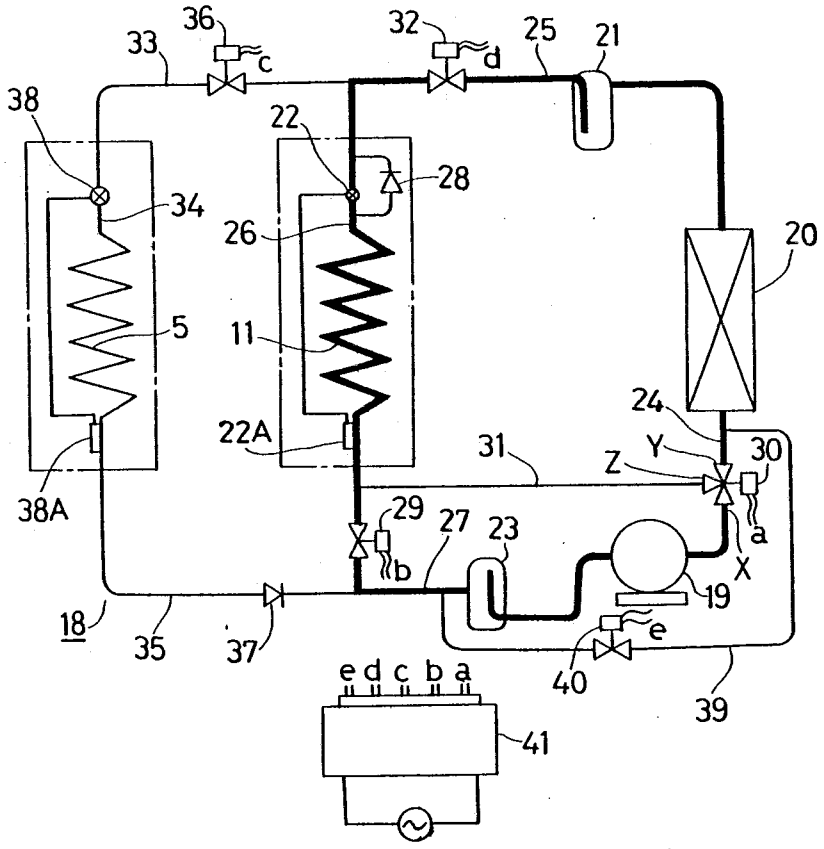
FIGS. 2, 3, 5 and 6 are diagrams illustrating refrigeration cycles of the embodiment.

FIG. 2 shows a refrigerator 18 (refrigeration cycle) for cooling the showcase. The refrigerator 18 comprises a refrigerant compressor 19, a water- or air-cooled heat exchanger 20 serving as a condenser, a receiver 21, a reducing valve 22, such as expansion valve or the like, having a temperature sensor 22A, the inner heat exchanger 11 and a gas-liquid separator 23. These components are connected into a loop by a high-pressure gas pipe 24, a high-pressure liquid pipe 25, a low-pressure liquid pipe 26 and a low-pressure gas pipe 27. Indicated at 29 is an electromagnetic valve mounted on the low-pressure gas pipe 27, at 30 a channel change-over valve, such as a three-way electromagnetic valve, mounted on the high-pressure gas pipe 24 and having one inlet port X and two outlet ports Y, Z, at 31 a hot gas bypass pipe having one end connected to the outlet port Z of the valve 30 and the other end connected to the low-pressure gas pipe 27 between the inner heat exchanger 11 and the valve 29, and at 32 an electro-magnetic valve mounted on the high-pressure liquid pipe 25. The outer heat exchanger 5 is connected in parallel with the inner heat exchanger 11. The heat exchanger 5 is connected to the high-pressure liquid pipe 25 and the low-pressure liquid pipe 27 by a high-pressure liquid branch pipe 33, a low-pressure liquid branch pipe 34 and a low-pressure gas branch pipe 35. Indicated at 36 is an electromagnetic valve mounted on the high-pressure liquid branch pipe 33, at 37 a check valve mounted on the low-pressure gas branch pipe 35, at 38 a reducing valve having a temperature sensor 38A for supplying a liquid refrigerant of reduced pressure to the heat exchanger 5, at 39 a recovery pipe for collecting the refrigerant from the heat exchanger 20 and the receiver 21 during defrosting, at 40 an electromagnetic valve mounted on the recovery pipe 39, and at 41 a control unit comprising a timer, etc. for feeding signals to the channel change-over valve 30 and electromagnetic valves 29, 32, 36, 40 for opening or closing the valve for a specified period of time. Opening or closing signals are emitted from lines a, b, c, d, e.

The low-temperature showcase is operated in the following manner.

Now, the first damper 4A and the second damper 4B are closed to render the inner passage 13 and the outer passage 7 independent of each other as seen in FIG. 1. At this time, the inlet port X of the valve 30 is in communication with the outlet port Y thereof, the valves 29, 32 are open, and the valves 36, 40 are closed in FIG. 2. When the refrigerant compressor 19 is operated in this state, the refrigerant flows through the channel of: compressor 19—channel change-over valve 30—condenser 20—receiver 21—electromagnetic valve 32—reducing valve 22—inner heat exchanger 11 serving as evaporator—electromagnetic valve 29—gas-liquid separator 23 compressor 19 to provide a first cycle as already known and shown in thick lines in FIG. 2. During this cycle, the refrigerant is condensed by the heat exchanger 20, has its pressure reduced by the reducing valve 22 and is evaporated by the inner heat exchanger 11. During this refrigeration operation (which is conducted, for example, for 4 hours), the air circulated through the inner passage 13 by the inner blower 12 is subjected to heat exchange with the low-pressure liquid refrigerant passing through the inner heat exchanger 11 to become cold air, forming a cold air curtain CA across the opening 3 as indicated by arrows in FIG. 1 to cool the storage chamber 17. In the meantime, the electromagnetic valves 32, 29 are turned on and off at the same time in response to temperature sensors (now shown) within the chamber 17 to maintain the chamber 17 at a proper temperature. On the other hand, the air circulated through the outer passage 7 by the outer blower 6 flows across the opening 3 along the cold air curtain CA outside thereof as indicated by arrows in FIG. 1 and is cooled to a slightly lower temperature than that of the outside air surrounding the open showcase 1 by being influenced by the cold air curtain, thus serving as a guard air curtain GA for holding the cold air curtain CA out of contact with the outside air.

Figure 3:
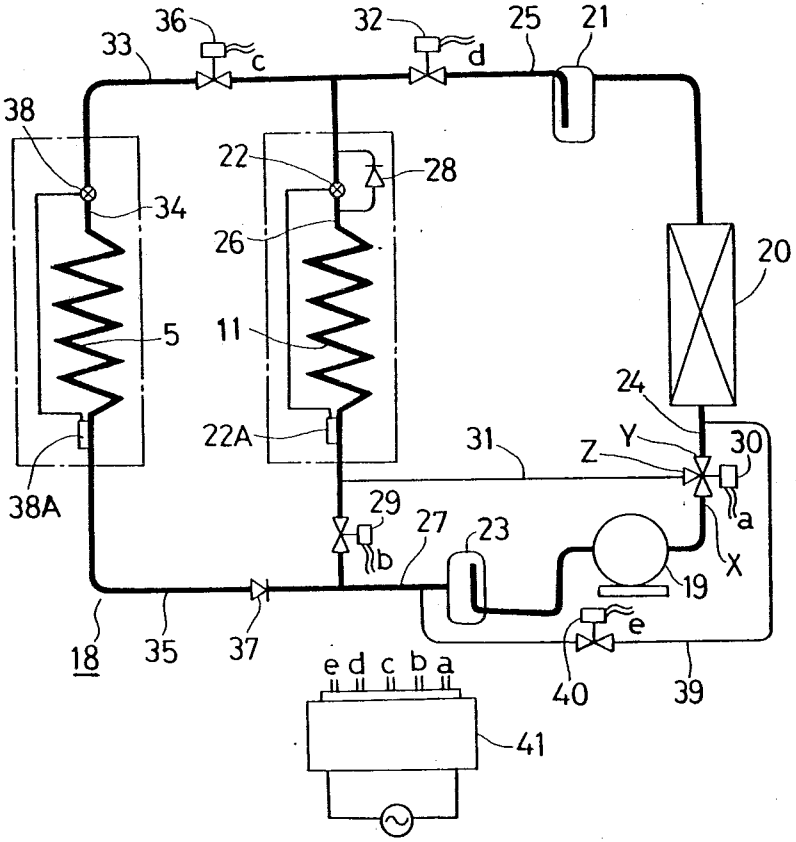

When an increased amount of frost builds up on the inner heat exchanger 11 with the progress of refrigeration operation, the electromagnetic valve 36 is opened for a specified period of time, e.g. 30 seconds, permitting the liquid refrigerant to partly flow into the high-pressure liquid branch pipe 33. The liquid refrigerant through the pipe 33 has its pressure reduced by the reducing valve 38, is evaporated by the outer heat exchanger 5 serving as an evaporator, flows through the low-pressure gas branch line 35 into the low-pressure gas pipe 27 and joins the refrigerant in the form of low-pressure gas and passing through the inner heat exchanger 11. The combined refrigerant returns to the compressor 19. Thus, the refrigerant provides a second cycle indicated in thick lines in FIG. 3. The operation of the second cycle is performed for several tens of seconds to several minutes before the refrigeration operation finishes, i.e. immediately before the refrigeration operation is changed over to defrosting operation, whereby the outer heat exchanger 5 is cooled to a lower temperature like the inner heat exchanger 11. Consequently, the air in circulation through the outer passage 7 is subjected to heat exchange with the low-pressure liquid refrigerant flowing through the outer heat exchanger 5 and maintained at the same temperature as, or a slightly higher temperature than, the cold air circulated through the inner passage 13. During this refrigeration operation, the outer blower 6 may be out of operation.

Figure 4:
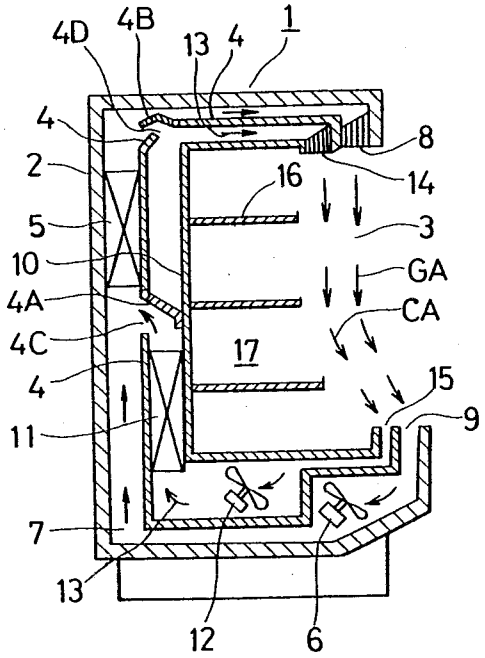
FIG. 4 is a view corresponding to FIG. 1 and showing the embodiment in a state different from that shown in FIG. 1.
Figure 5:
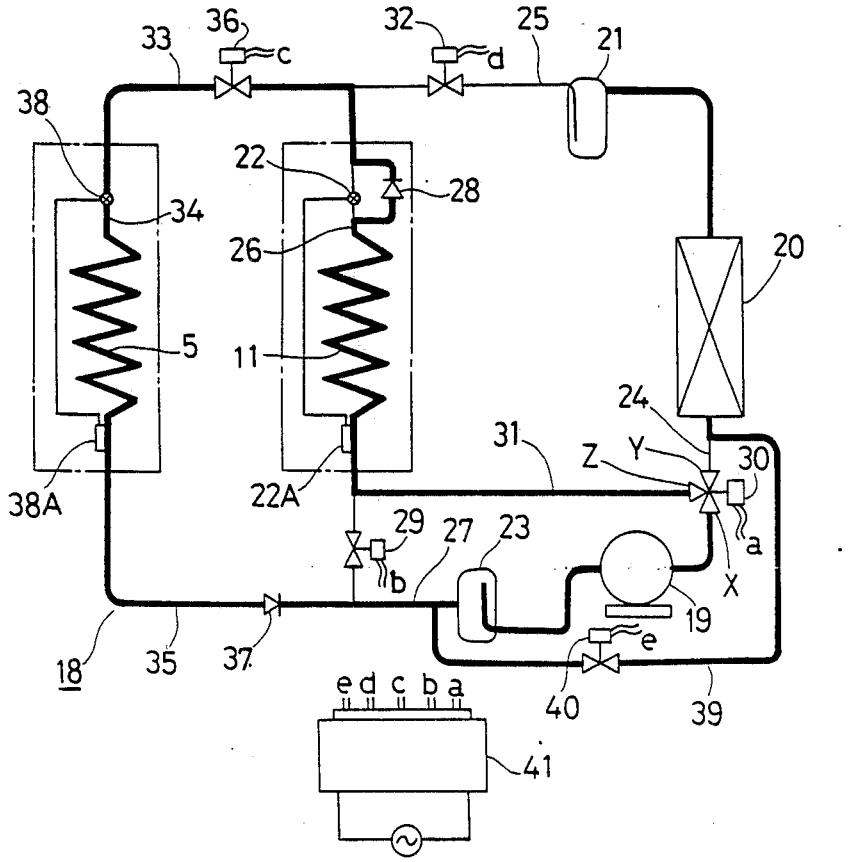

During the refrigeration operation, the temperature sensor 38A detects that the temperature of the outer heat exchanger 5 has dropped to a predetermined level, whereupon a defrosting start signal is emitted. In response to this signal, the electromagnetic valves 29, 32 are closed, the electromagnetic valve 40 is opened, the output port Z of the change-over valve 30 is opened in place of the port Y, and both the first and second dampers 4A and 4B are opened. The hot gas from the compressor 19 then flows through the circuit of: change-over valve 30—bypass pipe 31—inner heat exchanger 11—check valve 28—electromagnetic valve 36—reducing valve 38—outer heat exchanger 5—check valve 37—gas-liquid separator 23—compressor 19, while the refrigerant (chiefly in liquid state) stored in the receiver 21 and the heat exchanger 20 during the preceding refrigeration operation flows into the gas-liquid separator 23 via the recovery pipe 39 and the electromagnetic valve 40. Thus, the refrigerant provides a third cycle as indicated in thick lines in FIG. 5. In this cycle which is defrosting operation including recovery of the refrigerant, the hot gas is condensed to a high-pressure liquid state by the inner heat exchanger 11 serving as a condenser, and the liquid refrigerant has its pressure reduced by the valve 38 and evaporated by the outer heat exchanger 5. The condensation of the hot gas progressively melts the frost on the inner heat exchanger 11 and further gradually raises the temperature of the circulating air through the inner heat exchanger 11. The air through the exchanger 11 is prevented from further flowing through the inner passage 13 by the first damper 4A, flows through the first window 4C into the outer passage 7 and joins the air circulating through the outer passage 7. The confluent air passes through the outer heat exchanger 5 in heat exchange relationship with the low-pressure liquid refrigerant flowing therethrough and is thereby cooled. The cooled air in circulation is divided by the second damper 4B, whereupon a major portion of the air flows through the second window 4D into the inner passage 13, while the remaining portion passes between the second damper 4B and the heat insulating wall 2 and further flows through the outer passage 5. The divided air portions are forced out from the inner air outlet 14 and the outer air outlets 8, respectively, further flowing across the opening 3 to form air curtains CA and GA as in the refrigeration operation. Via the inner air inlet 15 and the outer air inlet 9, the air portions are returned to the inner and outer passages 7, 13 by the inner blower 12 and the outer blower 6. FIG. 4 shows these air circulation paths.

Figure 6:
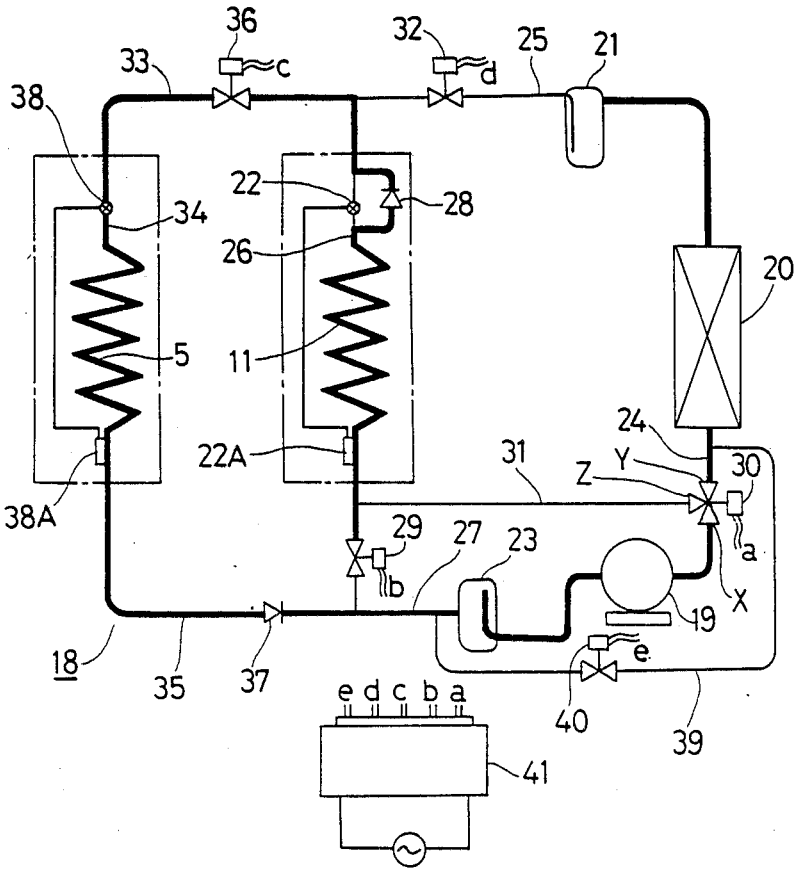

When the inner heat exchanger 11 is defrosted with the progress of the defrosting operation, the electromagnetic valve 40 is closed for a given period of time, e.g. 30 seconds, with the outlet port of the channel change-over valve 30 changed over from Z to Y. The refrigerator system is now in a refrigerant recovery cycle shown in thick lines in FIG. 6, in which the refrigerant remaining in the inner heat exchanger 11 and the outer heat exchanger 5 is led into the compressor 19 via the check valve 37 and the gasliquid separator 23 and then collected in the heat exchanger 20 and the receiver 21.

After a predetermined period of refrigerant recovery cycle, the electromagnetic valves 29, 32 are opened, the electromagnetic valve 36 is closed, and the first and second dampers 4A, 4B are closed to bring the system into refrigeration cycle shown in FIGS. 1 and 2.

According to the above mode of operation of the showcase 1, the air curtains CA and GA of different temperatures can be formed at the opening 3 during the refrigeration operation since the first and second dampers 4A and 4B are held closed. Further while the system is in the defrosting operation with the first and second dampers 4A and 4B in their open position, the refrigerant in the form of a hot gas is passed through the inner heat exchanger 11 in heat exchange relationship with the frost and the circulating air to undergo condensation, and the resulting liquid refrigerant is subjected to heat exchange with the circulating air by the outer heat exchanger 5 for evaporation. This prevents the liquid from returning to the compressor 19. Furthermore, the air circulating through the inner passage 13 is heated by the inner heat exchanger 11, then flows through the first window 4C into the outer passage 7 and is thereafter cooled by the outer heat exchanger 5 to a lower temperature than the outside air, whereupon the air returns to the inner passage 13 via the second window 4D to form the air curtain CA. Consequently, the air curtain CA, which has a low temperature as in refrigeration operation, shields off the cold air in the storage chamber 17 to reduce the rise of temperature of the chamber 17.

The first damper 4A which is openable toward the inner passage and the second damper 4B which is openable toward the outer passage are serviceable as deflectors for the circulating air and therefore give improved flow characteristics to the air.

With the low-temperature showcase 1 described above, when the inner heat exchanger is in defrosting operation, hot gaseous refrigerant, while defrosting this exchanger, is thereby converted to liquid refrigerant, which is then evaporated by the outer heat exchanger, while the circulating air heated by the inner heat exchanger is led through the first window into the outer passage, then cooled by the outer heat exchanger and discharged from the inner air outlet across the opening to form an air curtain. The showcase therefore has the following advantages.

(1) The air circulated through the inner heat exchanger and thereby heated is cooled by the outer heat exchanger to a temperature lower than the ambient or outside air before forming an air curtain, without being directly discharged from the outlet across the opening, whereby an air curtain having a lower temperature than the outside air can be provided for the opening. This reduces the rise of temperature of the storage chamber during defrosting, preventing degradation or deterioration of the refrigerated commodities during defrosting.

(2) During defrosting operation, the amount of heat given to the circulating air through the inner heat exchanger is removed by the outer heat exchanger to diminish the rise of temperature of the storage chamber. This shortens the period of time required for cooling the storage chamber to a predetermined temperature (i.e. for pull-down) after the resumption of refrigeration operation, hence an improved refrigeration efficiency.

(3) The refrigerant condensed by the inner heat exchanger is evaporated by the outer heat exchanger, so that the liquid refrigerant is prevented from returning to the compressor without using any defrosting container. This simplifies the refrigerator in construction.

FIGS. 7 to 12 show another embodiment, which will be described below.

Figure 7:
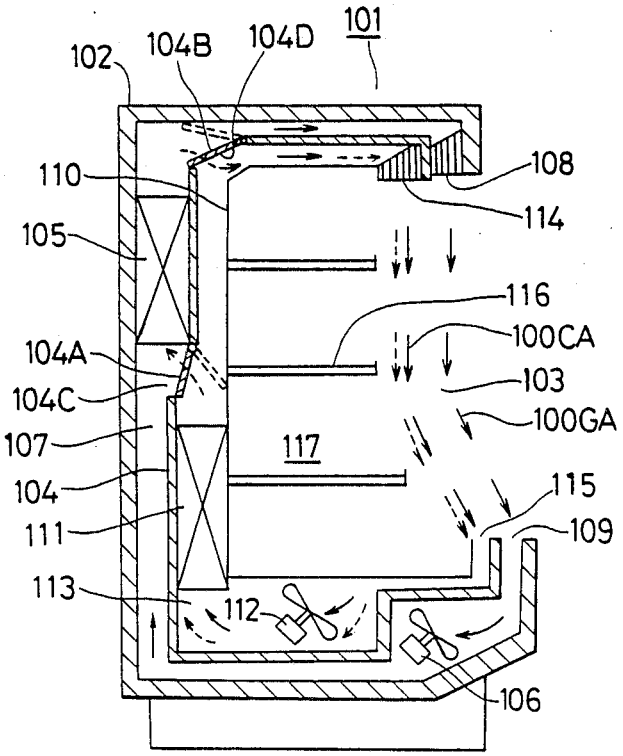
FIG. 7 is a view corresponding to FIG. 1 and showing another embodiment.
Figure 8:
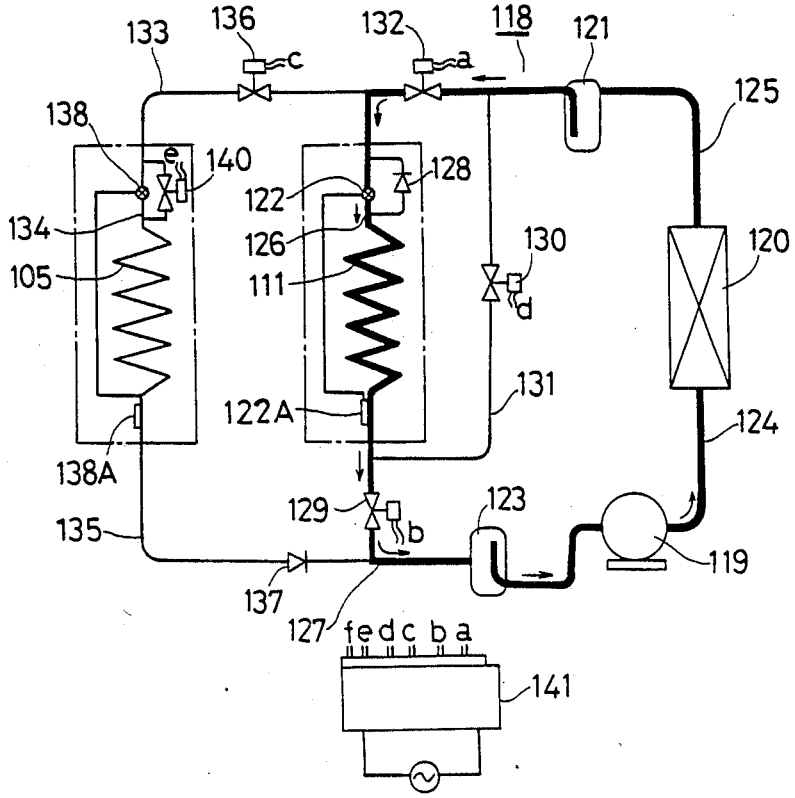
FIGS. 8 to 11 are views corresponding to FIGS. 2, 3, 5 and 6, respectively, and showing refrigeration cycles of the second embodiment.
Figure 9:
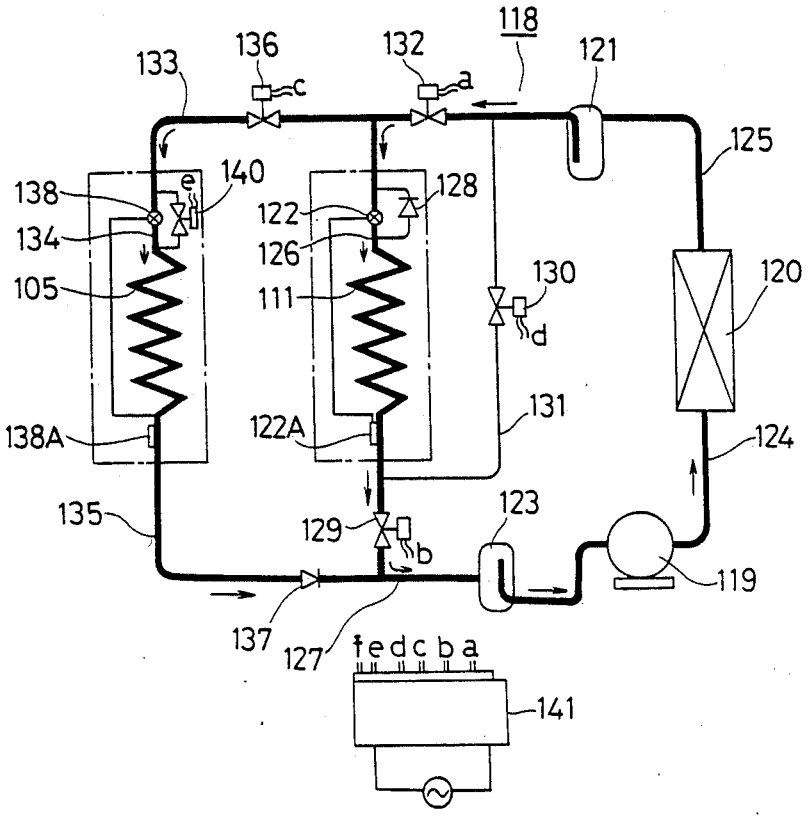
Figure 10:
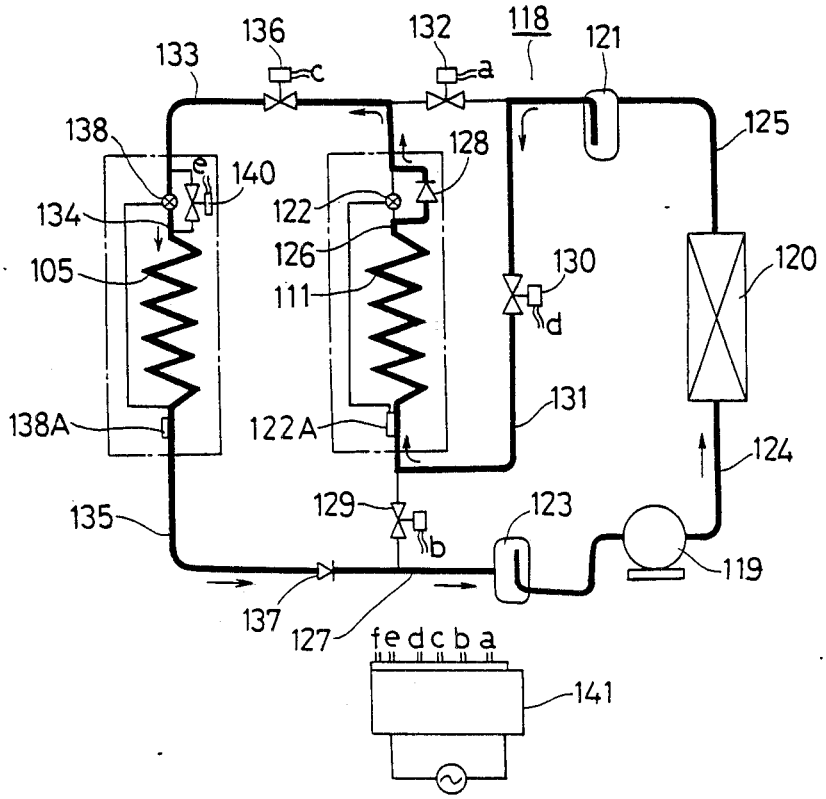
Figure 11:
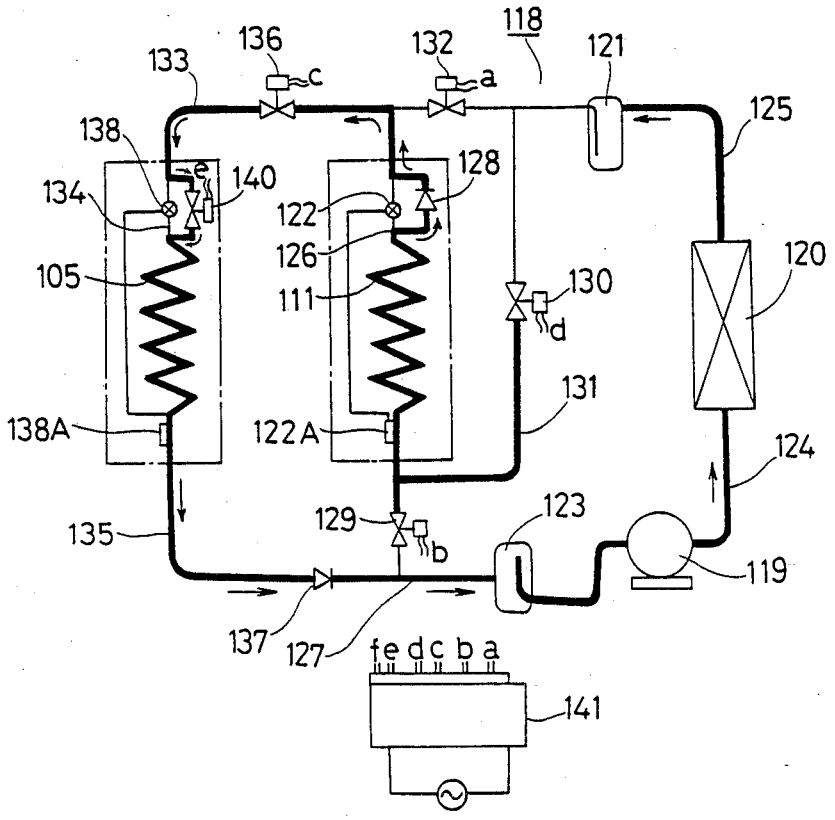

The showcase 101 illustrated has a second damper 104B, the free end of which is in contact with the inner surface of a heat insulating wall 102 when the damper is open as indicated in broken line in FIG. 7. The refrigeration cycle 118 is modified partly as shown in FIG. 8. With the exception of these features, the second embodiment is similar to the foregoing embodiment and therefore will not be described in detail.

With reference to the refrigeration cycle shown in FIGS. 8 to 11, a bypass circuit 131 has one end connected between a receiver 121 and a first electromagnetic valve 132 and the other end connected between an inner heat exchanger 111 and a second electromagnetic valve 129. The bypass pipe 131 has a third electromagnetic valve 130 which is opened while the inner heat exchanger 111 is in defrosting operation. A fifth electromagnetic valve 140, which is connected in parallel with a reducing valve 138, is opened upon completion of the defrosting operation of the exchanger 111. A control unit 141 comprising timers, etc. feeds signals from lines a, b, c, d, e and f to the first to fifth electromagnetic valves 132, 129, 130, 136, 140 and the first and second dampers 104A, 104B for opening or closing the valve or damper for a specified period of time.

The low-temperature showcase 101 operates in the following manner. When a defrosting signal is given while the system is in refrigeration operation of second cycle, the first and second electromagnetic valves 132, 129 are closed, the third electromagnetic valve 130 is opened, and the first and second dampers 104A and 104B are opened as indicated in broken lines in FIG. 7, whereby the system is changed over to defrosting operation. The liquid refrigerant from the receiver 121 flows through the circuit of: bypass pipe 131—inner heat exchanger 111—check valve 128—fourth valve 136—reducing valve 138—outer heat exchanger 105—gas-liquid separator 123—compressor 119, thus providing a modified third cycle shown in FIG. 10 by arrows. This modified third cycle is executed, for example, for 10 to 20 minutes for defrosting the inner heat exchanger 111. The liquid refrigerant from the bypass pipe 131 is passed through the inner heat exchanger 111 in heat exchange relation therewith and becomes a supercooling liquid while gradually defrosting the exchanger 111 with its sensible heat. On the other hand, the circulating air passing through this exchanger is blocked by the first damper 104A and prevented from further flowing through the inner passage 113, whereupon the air flows into the outer passage 107 via the first window 104C and is brought into heat exchange relationship with the liquid refrigerant of reduced pressure passing through the outer heat exchanger 105. The air in circulation and thus cooled is deflected by the second damper 104B, returned to the inner passage 113 through the second window 104D, discharged from an inner air outlet 114 across an opening 103 to form a cold air curtain 100CA as in refrigeration operation, and returned to the inner passage 113 via an inner air inlet 115. In this way, the air is repeatedly circulated through the system as indicated by broken-line arrows in FIG. 7.

When the inner heat exchanger 111 is defrosted with the progress of defrosting operation, the third valve 130 is closed and the fifth valve 140 is opened, with the first and second valves 132, 129 held closed, whereby the supply of liquid refrigerant to the exchanger 111 is discontinued. Consequently, the liquid refrigerant (partly containing saturated gas) remaining in the exchanger 111 is collected in the receiver 121 by so-called pump-down operation. Thus, the liquid refrigerant withdrawn from the inner exchanger 111 flows through the circuit of: fourth valve 136—fifth valve 140—outer heat exchanger 105—gas-liquid separator 123—compressor 119—condenser 120—receiver 121, in which the refrigerant is collected as high-pressure liquid as indicated by arrows in FIG. 11. This pump-down operation is conducted for several minutes to more than 10 minutes following the completion of defrosting operation of the inner heat exchanger 111. During this operation, the saturated gas refrigerant is first withdrawn from the exchanger 111 into the exchanger 105, and then the liquid refrigerant thereinto, permitting part of the refrigerant to evaporate within the inner exchanger 111 to cool the exchanger 111 with the latent heat of evaporation. Further the refrigerant flowing into the exchanger 105 in the form of liquid is evaporated while passing therethrough to cool the exchanger 105 with the latent heat of evaporation. The pump-down operation also serves to remove the condensed water from the inner exchanger 111. On completion of the pump-down operation, the fourth and fifth valves 136, 140 are closed, and the first and second valves 132, 129 are opened for the system to resume the refrigeration operation shown in FIG. 8.

Figure 12:
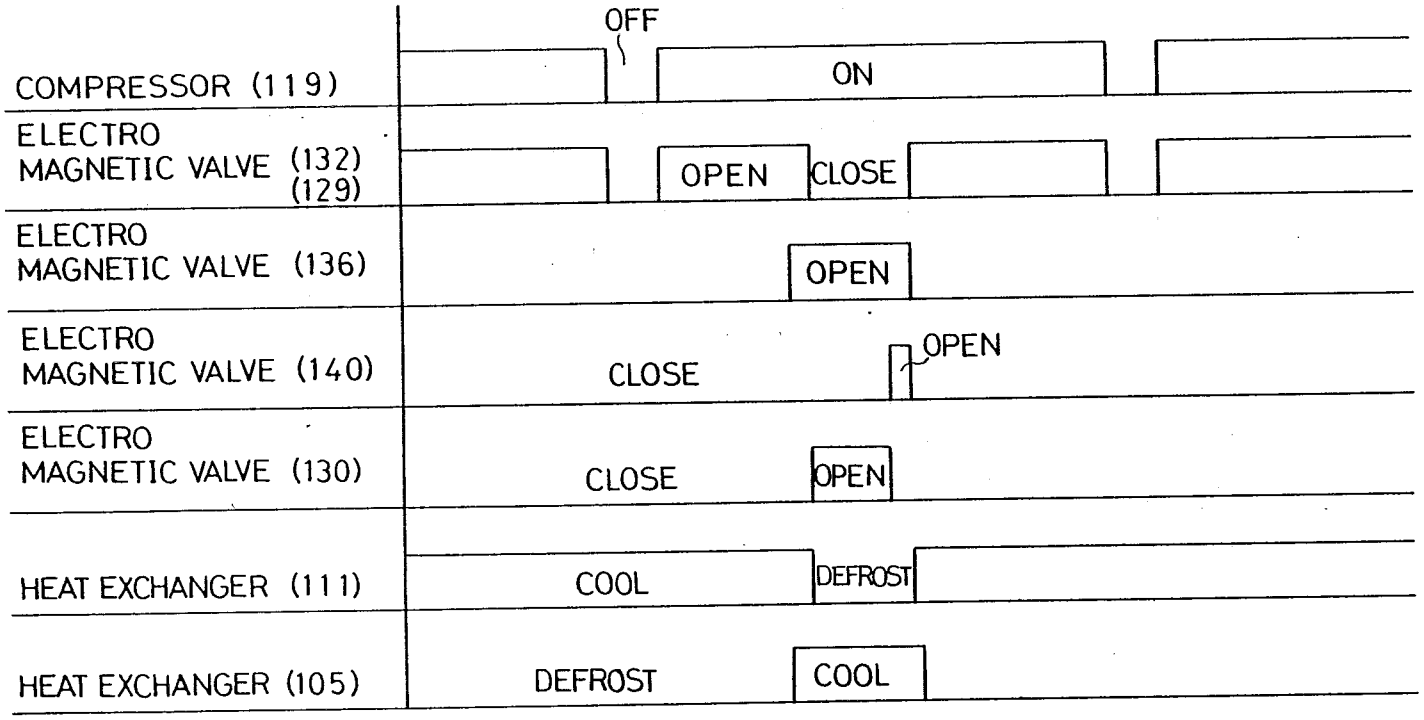
FIG. 12 is a time chart for illustrating the operation of the second embodiment.
Figure 13:
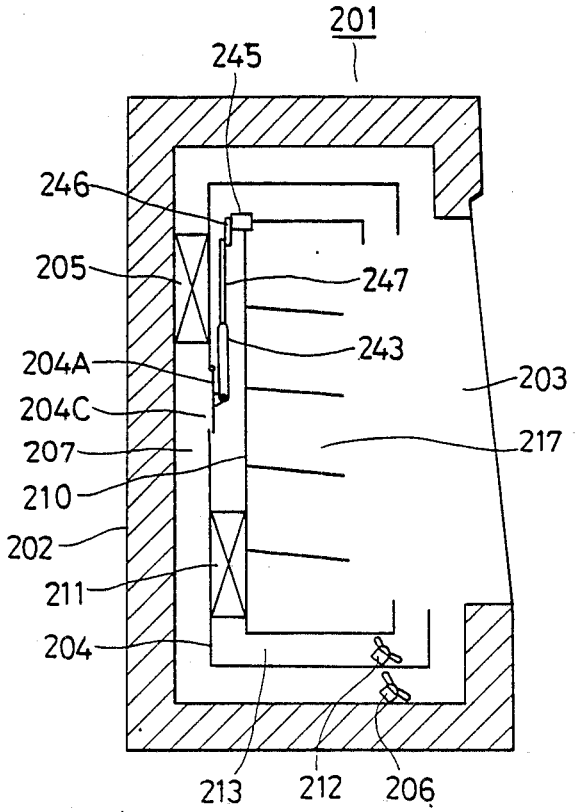
FIG. 13 is a diagram corresponding to FIG. 1 and showing another embodiment.
Figure 14:
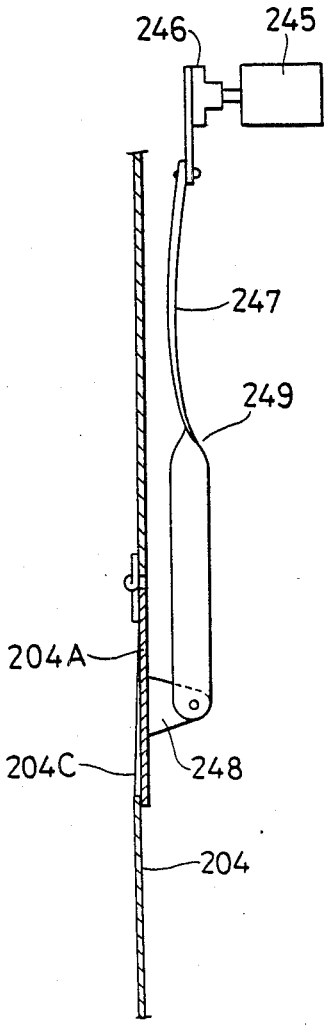
FIG. 14 is a side elevation in vertical section showing a damper assembly with a closure plate in closed position.
Figure 15:
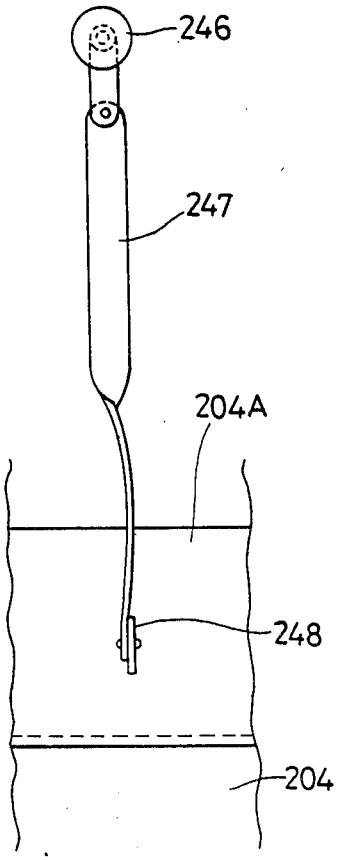
FIG. 15 is a front view of FIG. 14.
Figure 16:
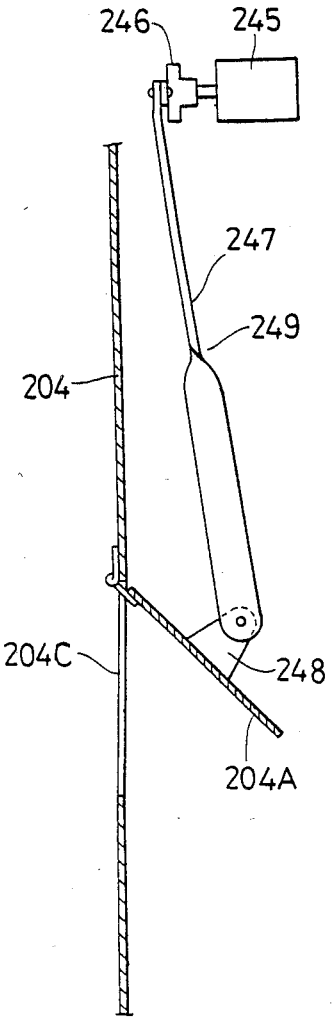
FIG. 16 is a side elevation in vertical section showing the damper assembly with its closure plate in opened position.
Figure 17:
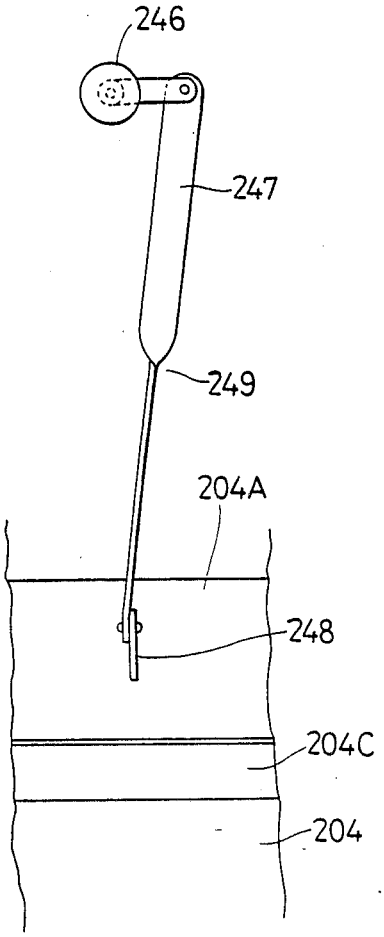
FIG. 17 is a front view of FIG. 16.

The time chart of FIG. 12 represents these modes of operation of the low-temperature showcase 101.

With the operation system described above, as is the case with the low-temperature showcase of FIGS. 1 to 6, low-pressure liquid refrigerant is passed through both the inner and outer heat exchangers 111, 105 at the same time before the start of defrosting operation, i.e., immediately before the completion of refrigeration operation, to maintain both the exchangers 111, 105 at a low temperature. Accordingly, the system can be changed over to defrosting operation after cooling the air through the outer passage 107 or inner passage 113. This reduces the rise of temperature of the air curtain 100CA at the opening 103 that will occur upon the change-over. Thus, the outer exchanger 105 is maintained at a low temperature before the start of defrosting operation, and in the initial stage of defrosting operation, the air heated by the sensible heat of liquid refrigerant which is supercooling by flowing through the inner heat exchanger 111 is cooled by the outer heat exchanger 111, so that the storage chamber 117 can be prevented from a great rise of temperature when refrigeration operation is changed over to defrosting operation. During defrosting operation, furthermore, the liquid refrigerant supercooling by the inner exchanger 111 is led through the outer exchanger 105 for heat exchange. This enables the outer exchanger 105 to exhibit an improved cooling action. On completion of defrosting operation, the liquid refrigerant remaining in the inner exchanger 111 is passed through the outer exchanger 105 for evaporation and is thereafter collected in the receiver 121 by the compressor 119. Consequently, both the inner and outer heat exchangers 111, 105 afford a cooling action even during pumpdown operation to thereby prevent a marked rise of temperature in the storage chamber 117. Moreover, the pumpdown operation prevents the liquid from returning to the compressor 119 when refrigeration operation is resumed, also assuring improved refrigeration initiation characteristics. Although the defrosting operation of the above embodiment described is conducted with the first and second dampers 104A, 104B left open, the operation can be carried out also with these dampers held closed. In this case, one air curtain which is somewhat warmer is thermally offset by the other air curtain which is cold when the operation is changed over.

To sum up, the low-temperature showcase 101 has the following advantages.

(1) When refrigeration operation is to be changed over to defrosting operation, a liquid refrigerant of reduced pressure is passed through both the inner and outer heat exchangers to cool the air circulating through the inner and outer passages, so that even when the system is brought into defrosting operation, the air curtain at the opening can be maintained at a low temperature, preventing the temperature of the storage chamber from rising greatly.

(2) During defrosting operation, a hot liquid refrigerant is passed through the inner heat exchanger and is thereby subcooled while defrosting the exchanger with the resulting sensible heat, and the supercooling liquid is subjected to heat exchange by the outer heat exchanger for refrigeration, with the result that the defrosting operation can be conducted almost without raising the temperature of the air through the inner passage, whereby the refrigerated commodities can be protected.

(3) During pump-down operation, the liquid refrigerant in the inner heat exchanger is collected in the receiver by way of the outer heat exchanger while permitting the inner and outer heat exchangers to exert a refrigerating action. This serves to protect the stored commodities also during pump-down, to prevent the return of liquid to the compressor when refrigeration operation is resumed and to assure an efficient cooling action from the start when the system is brought into refrigeration operation again.

A specific example of damper will be chiefly described below with reference to another embodiment shown in FIGS. 13 to 17. The low-temperature showcase 201 shown in FIG. 13 has substantially the same construction as the foregoing embodiments except that the partition wall 204 is not provided with any communication aperture (second window) or damper at a position downstream of a heat exchanger 205 in an outer passage 207. Accordingly the construction will not be described.

The partition wall 204 has a communication aperture 204C extending horizontally and positioned between heat exchangers 205 and 211. A damper assembly 243 comprises a closure plate 204A for opening or closing the communication aperture 204C, an electric motor 245, a cam 246 rotatable by the motor upon speed reduction, and an actuating plate 247 in the form of a spring member and having one end pivoted to the closure plate 204A and the other end pivotably supported by the cam 246. Ihe closure plate 204A is pivoted to the partition wall 204 at the upper edge of the aperture 204C and pivotally movable about a lateral axis. The above-mentioned one end of the actuating plate 247 is rotatably supported by a lateral pin on a bearing member 248 extending forward from the closure plate 204A. The other end of the actuating plate 247 is rotatably supported by a pin extending in the front-to-rear direction so as to be rotatable along the rear surface of the cam 246 which surface is substantially vertical. To realize such connection, the actuating plate 247 has an intermediate portion 249 which is twisted through about 90 degrees, is disposed within an inner passage 213 and extends vertically along the partition wall 204. As will be apparent from the above, the plate 247 is so twisted that one end thereof differs from the other end by about 90 degrees in phase. The motor 245 is attached to an upper portion of a partition wall 210.

During usual refrigeration operation, the closure plate 204A holds the communication aperture 204C closed, and the air cooled by the exchangers 211, 205 is circulated by blowers 206, 212, forming an air curtain comprising an inner cold air stream and an outer cold air stream which flows downward across a front opening 203. Now, the refrigerant circuit is changed over to defrost the exchanger 211 by passing a hot gas through the exchanger 211 and to bring the other exchanger 205 into refrigeration operation. At the same time, the motor 245 is operated to rotate the cam 246 through 180 degrees, thereby causing the closure plate 204A to open the aperture 204C and to block the passage 213. Consequently, the air circulated by the blower 212 passes through the heat exchanger 211 and flows through the heat exchanger 205 via the communication apcrture 204C. The air warmed by the exchanger 211 is therefore cooled by the exchanger 205 and flows across the front opening 203, whereby the temperature of commodity storage chamber 217 is prevented from rising. On completion of the defrosting operation, the motor 245 rotates reversely or the cam rotates further through 180 degrees to cause the closure plate 204A to close the aperture 204C, and the heat exchangers 211, 205 resume usual refrigeration operation.

During the operation described above, the actuating plate 247 deforms and restores itself when the closure plate 204A is opened or closed, owing to the resilient properties of the plate 247. Accordingly, even if the motor 245 and the closure plate 204A are not properly positioned relative to each other, the closure plate 204A can be opened or closed smoothly. Stated more specifically, the twist of the actuating plate 247 combines sidewise movement of the cam 246 with the forward or rearward movement of the closure plate 204A, absorbing the resistance to the movement of the plate 204A to render the plate 204A smoothly movable. Further because of the resilient properties of the actuating plate 247, the plate 247 slightly bends to press the closure plate 204A into contact with the partition wall when the aperture 204C is thereby closed, permitting the plate 204C to completely close the aperture. Also by virtue of the resilient properties of the actuating plate 247, the motor 245 can be stopped with the plate 247 in a slightly bent state, when the closure plate 204A closes the communication aperture 204C, such that the assembly will not be subjected to an abrupt excessive load even when motor 245 overruns.

According to the present embodiment, the twist of the actuating plate 247 relaxes the limitation on the position of the motor 245 relative to the closure plate 204A and eliminates the necessity of a special link mechanism. Thus, the position of the motor is not limited to that of the embodiment but can be suitably determined. Accordingly, one end of the plate 247 connected to the cam 246 may differ from the other end thereof connected to the closure plate 204A by an angle other than 90 degrees in phase.

In the case of the low-temperature case 201 described above, the closure plate can be opened or closed smoothly without subjecting the motor to an abrupt or great load. Further because the communication aperture can be closed by the closure plate properly, the air passages can be maintained in a satisfactory condition. The deviation of the motor relative to the closure plate can also be absorbed to reduce limitations in the arrangement. Thus, the arrangement is simple in construction and smaller in the number of components.

What is claimed is:

1. A low-temperature showcase comprising:

a case main body having at one side thereof an inlet-outlet opening for commodities and including an inner wall, an outer wall and a partition wall defining between the inner and outer walls an inner passage and an outer passage for passing air therethrough, two heat exchangers disposed in the inner passage and the outer passage respectively for providing refrigeration cycles along with a compressor, a condenser and reducing valves, blowers disposed in the inner and outer passages respectively for passing air through the two passages in the same direction and adapted to form at least a double air curtain at the inlet-outlet opening with the air circulated through the inner and outer passages, the heat exchanger in the inner passage being positioned upstream of and at a predetermined distance from the other heat exchanger with respect to the same direction of air flows, the partition wall having a first window at a portion thereof between the two heat exchangers, first passage change-over means for opening or closing the first window to close or open the inner passage downstream of the first window, and first control means for giving instructions to the first passage change-over means for its operation, the first control means being operative to instruct the first passage change-over means to open the first window and close the inner passage downstream of the first window when the heat exchanger in the inner passage is operated for defrosting with the heat exchanger in the outer passage operated for refrigeration, whereby the air flow through the heat exchanger in the inner passage is guided into the outer passage through the opened first window and cooled by being passed through the heat exchanger in the outer passage.

2. A low-temperature showcase as defined in claim 1 wherein the first passage change-over means is disposed in the inner passage and comprises a closure plate supported by the partition wall and pivotally movable about a lateral axis to open or close the first window, and drive means for driving the closure plate, and the closure plate blocks the flow of air downstream from the first window through the inner passage when opening the first window.

3. A low-temperature showcase as defined in claim 2 wherein the drive means comprises a cam, an electric motor for rotating the cam, and an actuating plate having one end pivotally supported by the cam and the other end pivoted to the closure plate and different from the supported end by a predetermined angle in phase, the actuating plate being a spring member and being twisted at an intermediate portion to provide the difference in phase.

4. A low-temperature showcase as defined in claim 1 wherein the partition wall has a second window at a portion thereof downstream of the heat exchanger in the outer passage and second passage change-over means for opening or closing the second window to close or open the outer passage downstream of the second window, the showcase further comprising second control means for giving instructions to the second passage change-over means for its operation.

5. A low-temperature showcase as defined in claim 4, wherein the second passage change-over means is disposed in the outer passage and comprises a closure plate supported by the partition wall and pivotally movable about a lateral axis between either one of two positions, one position being for opening the second, window and blocking a predetermined portion of the outer passage downstream of the second window, another position being for closing the second window, and further comprising drive means for moving the closure plate between the two positions.

6. A low-temperature showcase as defined in claim 4 wherein when the heat exchanger in the inner passage is operated for defrosting with the heat exchanger in the outer passage operated for refrigeration, the second control means instructs the second passage change-over means to open the second window so that the cold air flowing through the heat exchanger in the outer passage is partly or wholly guided into the inner passage through the second window.

7. A low-temperature showcase as defined in claim 6, wherein when the heat exchanger in the inner passage is operated for defrosting, either one of a hot high-temperature gas refrigerant obtained from the compressor in a refrigeration cycle or a hot liquid refrigerant obtained from the condenser is passed through the same heat exchanger and thereby converted to either one of a liquid refrigerant or supercooling liquid refrigerant, respectively, which is further passed through the heat exchanger in the outer passage for evaporation.

8. A low-temperature showcase as defined in claim 1 wherein before the heat exchanger in the inner passage is changed over to defrosting operation after operating for refrigeration by being supplied with a liquid refrigerant of reduced pressure, the liquid refrigerant of reduced pressure to be supplied to the heat exchanger in the inner passage is partly supplied to the heat exchanger in the outer passage to operate the latter exchanger for refrigeration.

9. A low-temperature showcase as defined in claim 8 wherein when the temperature of the heat exchanger in the outer passage has dropped to a predetermined level by being supplied with part of the liquid refrigerant of reduced pressure, the heat exchanger in the inner passage is changed over to defrosting operation, whereupon the first and second control means instruct the first and second passage change-over means to open the first and second windows.

10. A low-temperature showcase as defined in claim 1 wherein the inlet-outlet opening is formed in the front side of the case main body.

11. A low-temperature showcase comprising:

a case main body having at one side thereof an inlet-outlet opening for commodities and including an inner wall, an outer wall and a partition wall defining between the inner and outer walls an inner passage and an outer passage for passing air therethrough, two heat exchangers disposed in the inner passage and the other passage respectively for providing refrigeration cycles along with a compressor, a condenser and reducing valves, blowers disposed in the inner and outer passages respectively for passing air through the two passages in the same direction and adapted to form at least a double air curtain at the inlet-outlet opening with the air circulated through the inner and outer passages, the heat exchanger in the inner passage being positioned upstream of and at a predetermined distance from the other heat exchanger with respect to the same direction of air flows, the partition wall having a first window at a portion thereof between the two heat exchangers, first passage change-over means for opening or closing the first window to close or open the inner passage downstream of the first window, first control mens for giving instructions to the first passage change-over means for its operation, the first control means being operative to instruct the first passage change-over means to open the first window and close the inner passage downstream of the first window when the that exchanger in the inner passage is operated for defrosting with the heat exchanger in the outer passage operated for refrigeration, whereby the air flow through the heat exchanger in the inner passage is guided into the outer passage through the opened first window and cooled by being passed through the heat exchanger in the outer passage, the reducing valves being respectively connected in series with the two heat exchangers in the inner and outer passages for the refrigeration cycle, the series circuits being connected in parallel with each other, a bypass circuit connected between the heat exchanger in the inner passage and the compressor or the condenser for guiding either one of a hot high-pressure gas refrigerant from the compressor, or a hot liquid refrigerant from the condenser directly to the heat exchanger in the inner passage, and electromagnetic values included in the bypass circuit for guiding either one of the hot high-pressure gas refrigerant or hot liquid refrigerant from the heat exchanger in the inner passage to the other heat exchanger in the outer passage, when the exchanger in the inner passage is operated for defrosting.

12. A low-temperature showcase as defined in claim 11 wherein when the heat exchanger in the inner passage is operated for refrigeration, a liquid refrigerant of reduced pressure is supplied only to the same heat exchanger for evaporation, and when the refrigeration operation is to be terminated, the liquid refrigerant of reduced pressure is supplied to both the heat exchangers in the inner and outer passages, the electromagnetic valves being openable, when the heat exchanger in the inner passage is operated for defrosting, to pass the hot liquid refrigerant from the condenser through the bypass circuit into the heat exchanger in the inner passage and change the refrigerant into supercooling liquid refrigerant, which is then supplied to the heat exchanger in the outer passage for evaporation.

13. A low-temperature showcase as defined in claim 12 which further comprises a receiver for collecting therein the remaining liquid refrigerant withdrawn from the heat exchanger in the inner passage via the heat exchanger in the outer passage by pump-down operation when the supply of liquid refrigerant of reduced pressure from the condenser to the heat exchanger in the inner passage is discontinued by operating the electromagnetic valves upon completion of the defrosting operation of the heat exchanger.

14. A low-temperature showcase as defined in claim 11 wherein the first passage change-over means is disposed in the inner passage and comprises a closure plate supported by the partition wall and pivotally movable about a lateral axis to open or close the first window, and drive means for driving the closure plate, and the closure plate blocks the flow of air downstream from the first window through the inner passage when opening the first window.

15. A low-temperature showcase as defined in claim 14 wherein the drive means comprises a cam, an electric motor for rotating the cam, and an actuating plate having one end pivotally supported by the cam and the other end pivoted to the closure plate and different from the supported end by a predetermined angle in phase, the actuating plate being a spring member and being twisted at an intermediate portion to provide the difference in phase.

16. A low-temperature showcase as defined in claim 11 wherein the partition wall has a second window at a portion thereof downstream of the heat exchanger in the outer passage and second passage change-over means for opening or closing the second window to close or open the outer passage downstream of the second window, the showcase further comprising second control means for giving instructions to the second passage change-over means for its operation.

17. A low-temperature showcase as defined in claim 16, wherein the second passage change-over means is disposed in the outer passage and comprises a closure plate supported by the partition wall and pivotally movable about a lateral axis between either one of two positions, one position being for opening the second window and blocking a predetermined portion of the outer passage downstream of the second window, another position being for closing the second window, and further comprising drive means for moving the closure plate between the two positions.

18. A low-temperature showcase as defined in claim 16 wherein when the heat exchanger in the inner passage is operated for defrosting with the heat exchanger in the outer passage operated for refrigeration, the second control mens instructs the second passage change-over means to open the second window so that the cold air flowing through the heat exchanger in the outer passage is either one of partly or wholly guided into the inner passage through the second window.

19. A low-temperature showcase as defined in claim 18, wherein when the heat exchanger in the inner passage is operated for defrosting, either one of a hot high-temperature gas refrigerant obtained from the compressor in a refrigeration cycle, or a hot liquid refrigerant obtained from the condenser, is passed through the same heat exchanger and thereby converted to liquid refrigerant or subcooled liquid refrigerant, respectively, which is further passed through the heat exchanger in the outer passage for evaporation.

20. A low-temperature showcase as defined in claim 11 wherein before the heat exchanger in the inner passage is changed over to defrosting operation after operating for refrigeration by being supplied with a liquid refrigerant of reduced pressure, the liquid refrigerant of reduced pressure to be supplied to the heat exchanger in the inner passage is partly supplied to the heat exchanger in the outer passage to operate the latter exchanger for refrigeration.

21. A low-temperature showcase as defined in claim 20 wherein when the temperature of the heat exchanger in the outer passage has dropped to a predetermined level by being supplied with part of the liquid refrigerant of reduced pressure, the heat exchanger in the inner passage is changed over to defrosting operation, whereupon the first and second control means instruct the first and second passage change-over means to open the first and second windows.

22. A low-temperature showcase as defined in claim 11 wherein the inlet-outlet opening is formed in the front side of the case main body.

* * * * *